United States Patent [19]

Hartzell

[11] 4,371,162

[45] Feb. 1, 1983

[54] EXERCISING DEVICE

[76] Inventor: Richard P. Hartzell, 255 Westville Lake Rd., Beloit, Ohio 44609

[21] Appl. No.: 250,652

[22] Filed: Apr. 3, 1981

[51] Int. Cl.[3] ..... A63B 21/12; A63B 21/16; A63B 21/20

[52] U.S. Cl. ..... 272/134; 272/138

[58] Field of Search ..... 272/134, 136, 138, 137, 272/139, 135, 125, 142, 143, 144

[56] References Cited

U.S. PATENT DOCUMENTS

| | | | |
|---|---|---|---|
| 118,740 | 9/1871 | O'Connor | 272/138 |
| 1,663,641 | 3/1928 | Smallwood | 272/139 |
| 3,479,027 | 11/1969 | Fryer | 273/DIG. 30 |
| 3,636,946 | 1/1972 | Hardy | 272/138 X |

FOREIGN PATENT DOCUMENTS

| | | | |
|---|---|---|---|
| 578447 | 6/1959 | Canada | 272/134 |
| 345929 | 12/1904 | France | 272/136 |

*Primary Examiner*—George J. Marlo

*Attorney, Agent, or Firm*—Harvey B. Jacobson

[57] ABSTRACT

An improved exercising device includes a footboard on which an exerciser may stand and a pair of continuous loop elastic bands attachable to the footboard and being positionable over the exerciser's shoulders. A back harness is selectively attachable to the elastic bands to facilitate their retention over the exerciser's shoulders, while the footboard is provided with angulated slots for retaining the continuous elastic bands. Additionally, a base member is attachable to a bottommost portion of the footboard so as to prevent the elastic bands from rubbing against a ground surface, and elastic retaining loops are positionable between the slots to further retain the elastic bands in engagement with the footboard.

11 Claims, 5 Drawing Figures

EXERCISING DEVICE

BACKGROUND OF THE INVENTION

1. Field of the Invention

The present invention relates generally to exercising devices and more particularly pertains to a new and improved device for performing squatting exercises.

2. Description of the Prior Art

Exercising devices employing the use of footboards operably associated with stretching bands are generally well known in the art. For example, U.S. Pat. No. 118,740, issued to O'Connor on Sept. 5, 1871, discloses a footboard to which first ends of a plurality of springs may be attached, while the remaining free ends of the springs are provided with handles. To exercise using this device, an exerciser need only to stand upon the footboard while grasping the spring handles at which time squatting and similar exercises may be performed.

By the same token, U.S. Pat. No. 1,019,861, issued to Titus on Mar. 12, 1912, discloses a footboard having a plurality of elastic bands attached thereto, such elastic bands having a cross extending rod attached to their remaining free ends, whereby an exerciser may stand upon the footboard and position the rod behind his shoulders so as to perform squatting or similar exercises.

While both the O'Connor and Titus exercising devices can be used to perform squatting exercises, neither of these devices are particularly well adapted for use with continuous loop elastic bands, nor are they of a simplistic construction which would facilitate their disassembly and transportation. As such, it can be appreciated that there exists a continuing need for new and improved exercising devices which are simple in construction, easily transportable and economical to manufacture. In this respect, the present invention substantially fulfils this need.

SUMMARY OF THE INVENTION

The general purpose of the present invention, which will be described subsequently in greater detail, is to provide a new and improved exercising device that has all of the advantages of the prior art exercising devices and none of the disadvantages. To attain this, the present invention utilizes a footboard having angulated slots at remote ends thereof and continuous loop elastic bands which are positionable within the angulated slots. The continuous loop elastic bands are designed for positioning over a user's shoulders, and a back harness is provided between the bands to prevent them from becoming disengaged from the user's body. The footboard further includes a base which effectively holds the footboard out of ground engagement so as to prevent damage to the continuous loop elastic bands passing through the angulated slots.

It is therefore an object of the present invention to provide an improved exercising device that has all of the advantages of the prior art exercising devices and none of the disadvantages.

Another object of the present invention is to provide an improved exercising device that is compact and durable in its construction.

Still another object of the present invention is to provide an improved exercising device which is efficient and reliable in its operation.

Yet another object of the present invention is to provide an improved exercising device that may be easily and economically manufactured.

A further object of the present invention is to provide an improved exercising device which may be easily assembled and disassembled.

Even another object of the present invention is to provide an improved exercising device that may be safely used by an exerciser.

Still yet another object of the present invention is to provide an improved exercising device which may be easily transported and stored.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
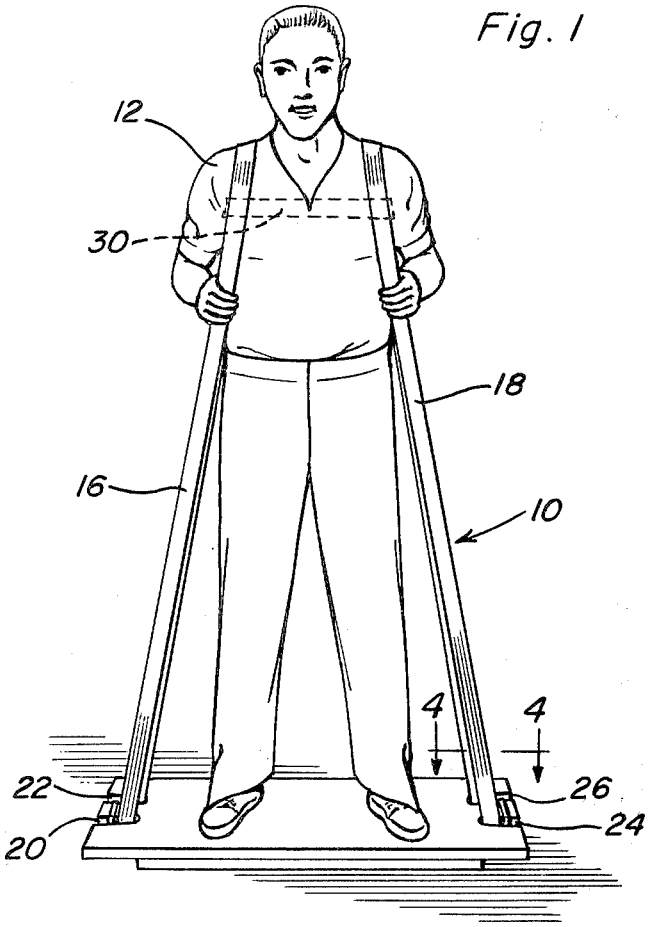
FIG. 1 is a perspective view of a person using the exercising device forming the present invention.
Figure 2:
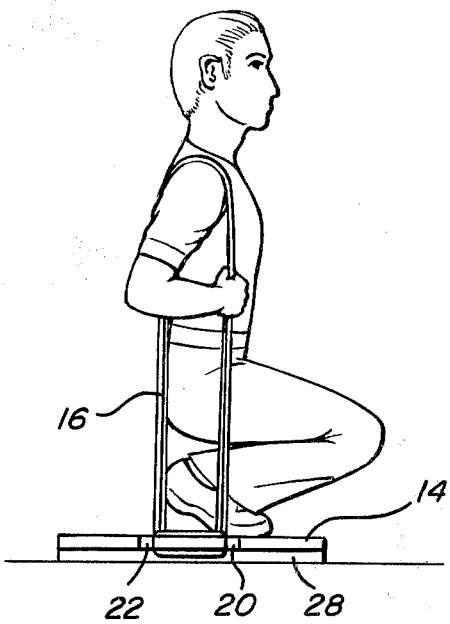
FIG. 2 is a side view of a person utilizing the exercising device forming the present invention.

With reference now to the drawings and in particular to FIGS. 1 and 2 thereof, an improved exercising device embodying the principles and concepts of the present invention and generally designated by the reference numeral 10 will be described. In this respect, a user or exerciser 12 is shown standing on a footboard 14 with a pair of continuous loop elastic bands or straps 16, 18 being positioned between the exerciser's shoulders and the footboard. Further illustrated is the fact that the continuous elastic bands 16, 18 are respectively positioned in angulated slots 20, 22 and 24 contained on longitudinally opposed ends of the footboard 14, while a base 28 is shown operably attached below the footboard. The base 28 serves to retain the footboard 14 in a non-surface engaging position whereby the respective ends of the straps 16, 18 will not be in engagement with a ground surface.

Figure 3:
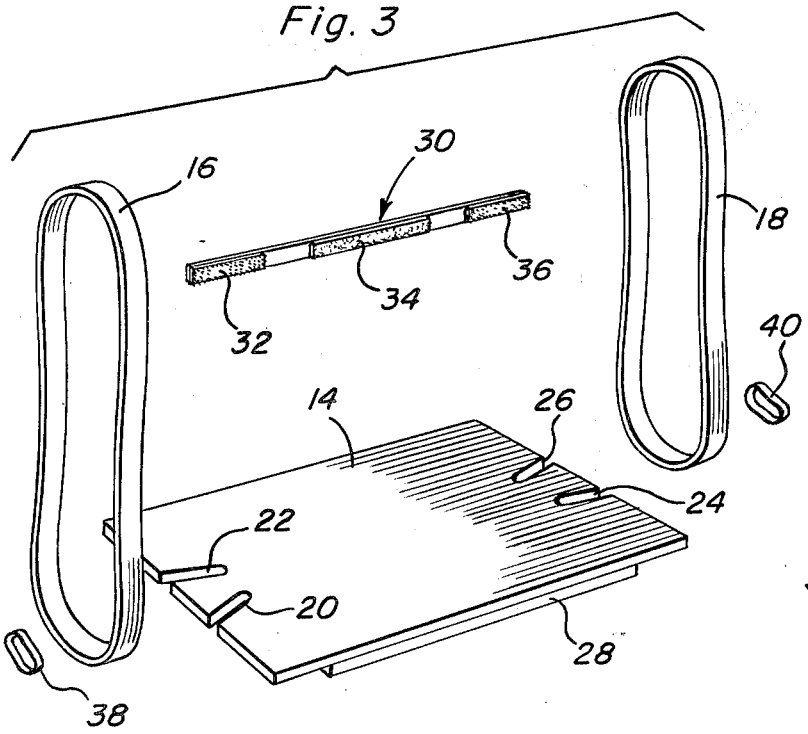
FIG. 3 is an exploded and perspective view of the parts of the present invention.

FIG. 3 is an exploded view of the parts associated with the present invention. In this connection, it can be seen that there is further provided a backstrap or harness member 30 which is selectively attachable between the elastic straps 16, 18 so as to facilitate their retention on an exerciser's shoulders as shown in FIG. 1. As shown, the backstrap 30 is provided with "Velcro" strips 32, 34, 36 which permit contact securement as desired in a manner yet to be described with reference to the further views of the drawings. FIG. 3 further serves to illustrate the continuous loop structure of the elastic straps 16, 18 and the manner in which the straps are respectively positionable in the slots 20, 22 and 24, 26. In this regard, the angulated slots 20, 22 are seen to be in a non-parallel relationship whereby the slots are directed at an angle towards one another to facilitate a retention of the elastic band 16 therein. By the same token, the angulated slots 24, 26 are similarly shown in a non-parallel relationship thereby to facilitate the retention of elastic band 18 therein.

Figure 4:
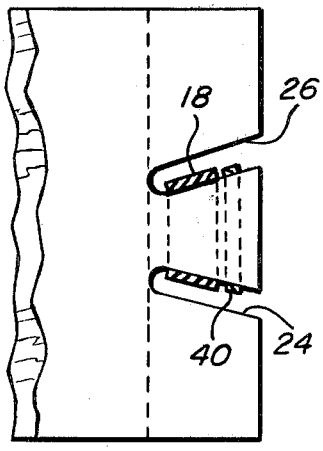
FIG. 4 is a detail view of the angulated slots associated with the present invention taken along the line 4—4 of FIG. 1.

Lastly illustrated in FIG. 3 is the use of retaining bands 38, 40, which could be of a rubber construction, respectively associated with the elastic bands 16, 18. With particular reference to FIG. 4 of the drawings, it can be seen that the retaining bands 38, 40 are stretchably positionable between the respective slots 20, 22 and 24, 26 so as to facilitate a retention of the elastic straps 16, 18 within the slots once they have been so positioned. Effectively, as shown in FIG. 4, retaining band 40 serves to prevent elastic strap 18 from sliding out of the slots 24, 26 which could present a danger of injury to the exerciser 12. Similarly, the retaining band 38 protectively retains elastic strap 16 within the slots 20, 22.

Figure 5:
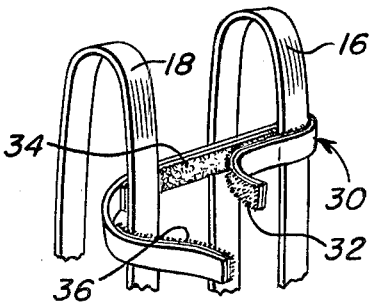
FIG. 5 is a detail and perspective view illustrating the manner of use of the backstrap associated with the present invention.

As to the assembled form of the present invention, FIG. 5 illustrates the fact that the back strap 30 is positionable between the respective elastic bands 16, 18 in a manner which permits "Velcro" portion 32 to be brought into contact engagement with "Velcro" portion 34 after being looped around the elastic strap 16, while "Velcro" portion 36 is brought into contact engagement with "Velcro" portion 34 after being looped around the elastic strap 18. As such, the back strap 30 serves to hold the elastic straps 16, 18 in a spaced apart relationship as aforedescribed, thereby to guard against the elastic straps sliding off of the shoulders of a user possibly resulting in an injury.

In use then, it can be seen that an exerciser need only assemble the exercising device 10 in the manner illustrated in FIGS. 3–5 when it is desired to use the same. Specifically, the user need only to place the footboard 14 on a flat surface and then engage both of the elastic straps 16, 18 within their respective retaining slots 20, 22 and 24, 26. Once the elastic straps 16, 18 are within the slots 20, 22 and 24, 26, the respective retaining bands 38, 40 may be slippd into the slots so as to securely position the elastic straps relative to the footboard 14 once tension is applied thereto. The back strap 30 may be then be operably attached between the elastic straps 16, 18 in the manner illustrated in FIG. 5, and a user may then position his body in the manner most clearly illustrated in FIG. 2. Specifically, the user need only to position the elastic straps 16, 18 over his shoulders as shown in FIG. 2, and then move into a standing position so as to achieve exercise of the various muscles in his body.

In summary, the exercising device 10 provides a very simple and unique method by which an individual 12 can improve his quadriceps and gastrocnemius strength, along with his cardiovascular circulation. The exercising device is compact and can be used in any room in a house, or alternatively, several can be used at one time in a gymnasium or similar setting. The exercising device is of a low cost construction and is not nearly as cumbersome as bar bells or similar devices commonly used for the purpose of improving vertical jump ability as well as general overall body strength. Additionally, the bands, backstrap and footboard take up very little space while at the same time providing most of the exercise a user can get from weight lifting.

As can be further appreciated, the transporting and safety features associated with the invention are outstanding. An individual can carry 2,000 lbs. or more of pressure in a normal gym bag provided by the strength of the elastic straps which weigh less than 2 lbs. each. As is well understood in the art, weights are frequently dropped which result in injury to lifters or observers, and further, the noise from utilizing weights is quite irritating, whether in a home or in a gymnasium. The construction of the present invention eliminates these problems. Additionally, the exercising device forming the present invention can be utilized by either males or females who desire to improve their fitness, while various elastic bands can be provided to meet the size and strength needs of a person, whether or not that person is an elementary school student or a professional athlete. Finally, the exercising device provides excellent anaerobic exercise inasmuch as the strength or resistance of the elastic bands can be increased as desired, or additional bands can be added to double the strength of resistance during a workout. In this regard, anaerobic relates to a short quick burst of energy such as experienced in sprinting.

With respect to the above description then, it should be realized that the optimum dimensional relationships for the parts of the invention are deemed readily apparent and obvious to one who is skilled in the art to which the invention pertains, and all equivalent relationships to those illustrated in the drawings and described in the specification, to include modification of form, size, arrangement of parts and details of operation, are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An improved exercising device comprising: footboard means having longitudinally opposed ends each including a set of angulated slots positioned intermediate to each of the opposed ends, a base supporting and operably attached below the footboard means to support the footboard means in spaced relation from a supporting surface, and a set of continuous elastic band means for use in exercising and adapted to have a portion thereof positionably received within the set of angulated slots and having a portion distal from the received portions of the elastic band means adapted to be positionably received about an exerciser's body to facilitate said exercising, the base supporting the footboard means sufficiently so spaced from the supporting surface to prevent the received portions of the elastic band means from coming into engagement with the supporting surface in order to prevent damage thereto, the angulated slots having the orientation thereof directed toward one another of the set and to a central portion of the footboard means to facilitate a retention of said elastic band means within said set of slots.

2. The improved exercising device as defined in claim 1 wherein the set of elastic band means include essentially equi-tensioned elastic bands, the set of elastic band means further provide that various elastic bands meet size and strength needs of the exercizer, and that additional bands can be added to double or otherwise modify the strength of resistances in said exercising during a workout.

3. The improved exercising device as defined in claim 1, and further including harness means to facilitate a retention of said elastic band exercise means in contact securement about said exerciser's body.

4. The improved exercising device as defined in claim 3, and further wherein said harness means includes a strap positionable between said two elastic band means and having a "Velcro" portion defining a hook tape and another "Velcro" portion defining a pile tape, the portions cooperating to effect a lengthwise adjustment and attachment of said harness means to said two elastic band means when the two portions are pressed together.

5. An exercising device comprising a rigid footboard having a planar upper surface on which a user can be positioned when exercising, a base underlying a major portion of the footboard and including a planar lower surface parallel to the upper surface, said lower surface of the base engaging a support surface to provide stable support for the footboard when a user engages the footboard in an off center position, said footboard including a pair of opposed end edges with each end edge including a pair of inwardly extending slots extending inwardly from the end edge and terminating adjacent the end of the base, the upper surface of the footboard being free of obstructions and the slots being disposed centrally of the end edges, said pair of slots at one end of the footboard being spaced from the slots at the other end of the footboard a distance to receive the feet of a user when standing in a normal stance with the feet spaced apart thereby enabling a user to position his feet in various positions on the upper surface of the footboard including positions parallel to the end edges and perpendicular thereto without encountering obstructions, an elastic strap of one-piece endless construction having a portion thereof received in one pair of slots with the remaining portion extending above the footboard for engagement by a user, said strap having a rectangular cross-sectional configuration for comfortably engaging body surface areas of a user, said strap being readily detachable from the slots to enable selective use of straps having different dimensional characteristics and strength characteristics to enable a user to practice various exercising programs by the user changing position on the footboard and changing relationship with the strap.

6. The structure as defined in claim 5 wherein said slots converge inwardly whereby tension on the strap will retain it in the slots when the strap extends upwardly therefrom.

7. The structure as defined in claim 5 wherein the outer ends of the slots are spaced inwardly from the ends of the end edge of the footboard to enable a user to position a foot on the footboard alongside of and outwardly of each pair of slots.

8. The structure as defined in claim 5 together with a second elastic band in the other pair of slots, said straps being of identical construction to engage over the shoulders of a user, and an inelastic connector strap detachably interconnecting said elastic straps adjacent the portion thereof engaged over the shoulders to retain the elastic straps on the shoulders when performing squat-type exercises and the like.

9. The structure as defined in claim 5 wherein said footboard and base are of substantially equal thickness rigid panels which are rigidly connected to form a total vertical thickness which is small relative to the horizontal dimensions to facilitate use of the device.

10. The improved exercising device as defined in claim 5, and further including retaining means associated with said slots so as to retain said elastic strap therein.

11. The improved exercising device as defined in claim 10, and further wherein said retaining means consist of elastic rubber bands.

* * * * *